US010283853B2

(12) United States Patent
Gerneth et al.

(10) Patent No.: US 10,283,853 B2
(45) Date of Patent: May 7, 2019

(54) ANTENNA MODULE

(71) Applicant: Hirschmann Car Communication GmbH, Neckartenzlingen (DE)

(72) Inventors: Christian Gerneth, Kirchentellinsfurt (DE); David Silva, Nuertingen (DE)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 0 days.

(21) Appl. No.: 15/502,964

(22) PCT Filed: Sep. 9, 2015

(86) PCT No.: PCT/EP2015/070639

§ 371 (c)(1),
(2) Date: Mar. 7, 2017

(87) PCT Pub. No.: WO2016/038102

PCT Pub. Date: Mar. 17, 2016

(65) Prior Publication Data

US 2017/0229768 A1 Aug. 10, 2017

(30) Foreign Application Priority Data

Sep. 9, 2014 (DE) ..... 10 2014 013 070

(51) Int. Cl.

| | |
|---|---|
| ***H01Q 1/32*** | (2006.01) |
| ***H01Q 1/12*** | (2006.01) |
| ***H01Q 1/52*** | (2006.01) |

(52) U.S. Cl.
CPC ..... *H01Q 1/3275* (2013.01); *H01Q 1/12* (2013.01); *H01Q 1/1214* (2013.01); *H01Q 1/526* (2013.01)

(58) Field of Classification Search
CPC .... H01Q 1/3275; H01Q 1/1214; H01Q 1/526; H01Q 21/28
See application file for complete search history.

(56) References Cited

U.S. PATENT DOCUMENTS

| | | | |
|---|---|---|---|
| 8,462,059 | B2 | 6/2013 | Schnuerer |
| 9,270,018 | B2 | 2/2016 | Mierke |
| 2015/0123854 | A1 | 5/2015 | Chakam |

FOREIGN PATENT DOCUMENTS

| | | | |
|---|---|---|---|
| DE | 295000961 | U | 7/1995 |

*Primary Examiner* — Hoang V Nguyen
(74) *Attorney, Agent, or Firm* — Andrew Wilford

(57) ABSTRACT

The invention relates to an antenna system (1) having a housing (2), in which a printed circuit board is provided, and at least one antenna element (8), the at least one antenna element (8) being arranged inside a cover. A motherboard (11) without an antenna element (8) is preferably arranged inside the housing (2), an antenna circuit board (12) is provided at a distance from the motherboard (11), outside the housing (2), and the at least one antenna element (8) is arranged on the antenna circuit board (12).

5 Claims, 2 Drawing Sheets

ANTENNA MODULE

CROSS REFERENCE TO RELATED APPLICATIONS

This application is the US-national stage of PCT application PCT/EP2015/070639 filed 9 Sep. 2015 and claiming the priority of German patent application 102014013070.3 itself filed 9 Sep. 2014.

FIELD OF THE INVENTION

The invention relates to an antenna system having a housing holding a printed-circuit board and at least one antenna element in a cover.

BACKGROUND OF THE INVENTION

An antenna system of this generic type is known from DE 10 2012 208 303 [US 2015/0123854]. The antenna system disclosed therein (referred to as an antenna module) has a housing holding a printed-circuit board. This printed-circuit board is referred to as an antenna circuit board. Several antenna elements of the same type or of different types are provided on the upper face of the antenna circuit board, each of which has its respective connections on the antenna circuit board. Shield plates are provided between the antenna elements so that the high-frequency signals emitted from and/or received by them do not interfere with each other.

The lower face of the circuit board carries electronic circuits that further process the high-frequency signals received from the antenna elements or process signals to be emitted by the antenna elements. Additional shield plates are, in turn, provided beneath the antenna circuit board in order to block high-frequency emissions from the antenna module or incident radiation into the antenna module. The electronic circuits are in contact with the connections of the antenna elements, so that the connections (also called the base point) of the antenna element is connected directly to the respective electronic circuit. The antenna elements are provided under an outer cover. The antenna module is guided with its outer cover through an aperture in a body panel of a vehicle, so that, on the one hand, the antenna elements beneath the outer cover project past the surface of the body panel and the high-frequency signals to be received can be reached by the antenna elements. Moreover, this makes it possible for the antenna elements to emit high-frequency signals without being blocked so by the body panel made of an electrically conductive material. On the other hand, the housing of the antenna module is provided beneath the body panel so that it can be provided and fastened in this installation space.

The electronic circuits provided on the antenna circuit board therefore also operate in the high-frequency range, for which reason it is necessary to provide shield plates beneath the antenna circuit board. Moreover, the electronic circuits therefore operate not only in the high-frequency range, but also in the intermediate and low-frequency range as well.

OBJECT OF THE INVENTION

It is the object of the invention to provide an improved antenna system of this generic type with respect to its construction such that the performance characteristics are improved.

SUMMARY OF THE INVENTION

According to the invention, a primary circuit board with or without the antenna element is provided inside the housing, and the at least one antenna element is spaced from the primary circuit board and provided outside the housing. In this case, the at least one antenna element located outside the housing is contacted directly, for example via a directly connected cable or plug connector, so that a support (an antenna circuit board, for example) for the at least one antenna element can be advantageously omitted. Alternatively or in addition, in one preferred embodiment, a primary circuit board without antenna element is provided according to the invention inside the housing, and an antenna circuit board is provided outside the housing so as to be spaced from this primary circuit board, with the at least one antenna element being provided on the antenna circuit board.

As a result, it is possible in these two variants to advantageously separate the region in which high frequency is used from the region in which intermediate and/or low frequency is used. This means that the primary circuit board can be advantageously provided with electronic circuits in the housing and operated in the low- and intermediate frequency range and be shielded by the housing from high-frequency signals. At the same time, there is the antenna circuit board that carries the at least one antenna element, or also several antenna elements, and can thus be optimally adapted to operation in the high-frequency range. Moreover, this separation of the two circuit boards enables the optimal arrangement of the antenna system in the available installation space. Accordingly, when using the antenna system in a vehicle, the antenna circuit board can be provided level with or preferably somewhat above a body panel in order to achieve optimal transmission and/or reception characteristics. At the same time, the housing with the primary circuit board provided therein can be provided and fastened underneath the body panel. This is advantageously done independently of the provision of the antenna circuit board if the associated connections of the primary circuit board and antenna circuit board (i.e., the base point of an antenna element on the antenna circuit board and associated connections on the primary circuit board) are not rigidly interconnected but rather are joined by a flexible connection, for example by a plug connector, cable, or the like. The electrical connection between the respective connections of the primary circuit board and the associated base points of the antenna circuit board (in the case of transmission of high-frequency signals; otherwise, the other way around), allows one to vary the spacing between these two circuit boards in order to optimally exploit the installation space, to compensate for tolerances, and, if the antenna system is used in a vehicle, to enable the use of body panels of different thicknesses.

In a development of the invention, the housing has at least one aperture for introducing means for connecting the primary circuit board to the antenna circuit board. The at least one antenna element is provided with its base point on the antenna circuit board. This is a conductive contact area on the antenna circuit board. Likewise, the primary circuit board has an associated contact point that is connected to a downstream electronic circuit. To enable these two contact points to be interconnected in order to either emit signals from the electronic circuits via the antenna elements or to feed high-frequency signals that are received from the at least one antenna element to the associated electronic circuit, means such cables, plug connectors, or the like are provided that are passed through the aperture of the housing. One possibility that merits consideration here is to provide each cable with its own aperture or to group together several cables, depending on the number of antenna elements, or to group all of the cables together in order to pass them through an aperture so that they reach into the housing and can be contacted there. The same applies to plug connectors. The size of the at least one aperture in the housing is selected such that it is large enough for the means for connecting the primary circuit board to the antenna circuit board to be introduced but not substantially larger, so that, in the case of a housing that is made of an electrically conductive material (such as die-cast zinc, for example), effective electrical shielding of the primary circuit board and its at least one electronic circuit located therein can be achieved.

In a preferred embodiment of the invention, as a means for connecting to the antenna circuit board, the primary circuit board has one plug connector and the antenna circuit board has another plug connector fittable with the one plug connector. It is thus possible in a simple manner for the antenna system to be constructed in modular fashion so that it can be installed with greater ease. For instance, the antenna circuit board can be provided with antenna elements and one plug connector, thereby forming a first module of the antenna system. Likewise, the primary circuit board is provided with electronic circuits and provided in the housing, with another plug connectors of the primary circuit board projecting through the aperture in the housing. Another module is thus formed. If the two modules are installed in their place of installation, the electrical connection between antenna circuit board and primary circuit board can be established in a quick and uncomplicated manner by simply plugging the two mutually interfittable plug connectors together. It is thus possible, for example, to arrange and fasten the antenna circuit board, which is optionally provided in a housing or beneath a cover, in its installation site. After this has been done, the second module is plugged into the first module that has already been installed via the plug connectors and also provided and fastened in its intended place. An inverse procedure is of course also conceivable.

BRIEF DESCRIPTION OF THE DRAWING

The invention is described and explained in further detail below with reference to the figures in which.

SPECIFIC DESCRIPTION OF THE INVENTION

Figure 1:
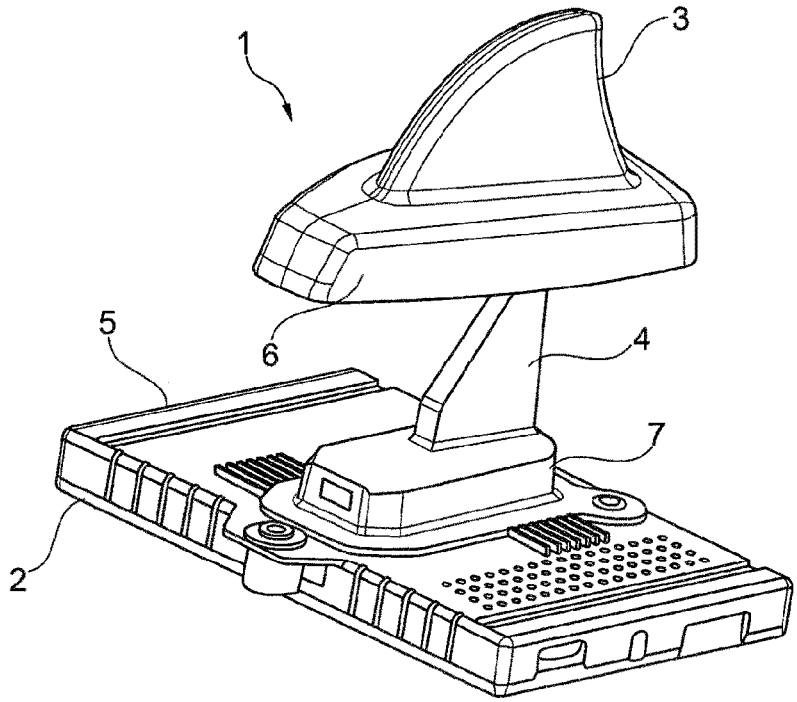
FIG. 1 is a perspective exploded view from above of the invention.

As a preferred application of the antenna system according to the invention, the drawing shows the installation thereof in a vehicle.

A vehicle is therefore preferred that has an antenna system having a housing holding a circuit board and at least one antenna element that is provided inside a cover, a primary circuit board without antenna element being provided inside the housing provided on one side of a body panel of the vehicle, and an antenna circuit board provided on the other side of the body panel of the vehicle is provided so as to be spaced from the primary circuit board and outside the housing, with the at least one antenna element being provided on the antenna circuit board.

Although this application of the antenna system according to the invention in a vehicle is preferred and the following description applies particularly to this particular application, it is not limited thereto. FIG. 1 shows, insofar as shown in detail, a three-dimensional view of an antenna system 1 having a housing 2. In this application of the antenna system 1, a cap 3 is provided that can be seen from the outside when viewing the vehicle (for example, on the roof of the vehicle). Moreover, the antenna system 1 has an outer cover 4. An upper face of the housing is indicated at 5, and a lower face of the optional cap 3 at 6. An outer edge rim the outer cover 4 is shown at 7.

Figure 2:
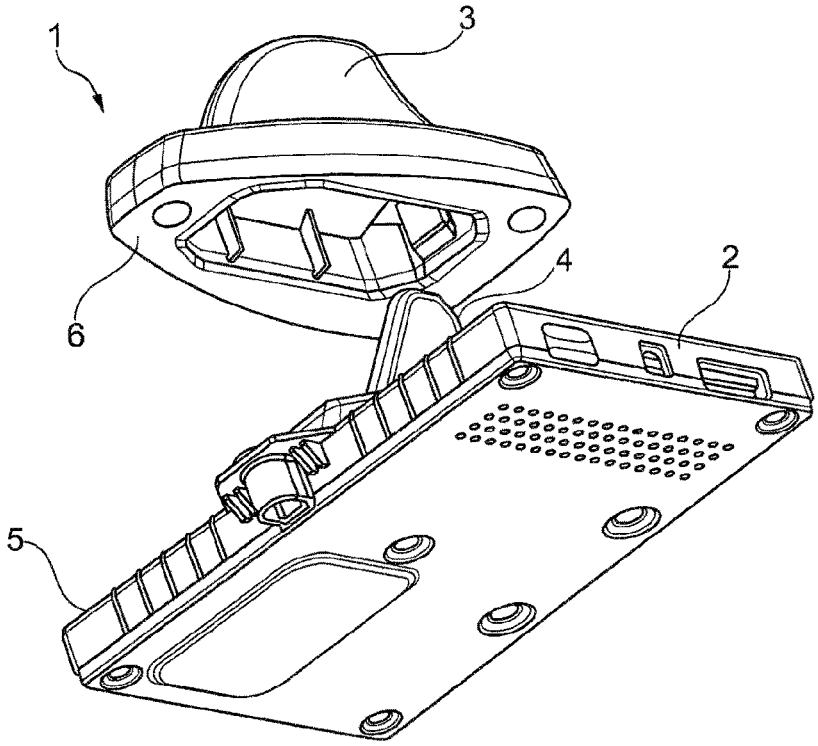
FIG. 2 is a perspective exploded view from below of the invention.

FIG. 2 is a view from another perspective of the antenna system 1 in which the elements already described in FIG. 1 can be seen.

Figure 3:
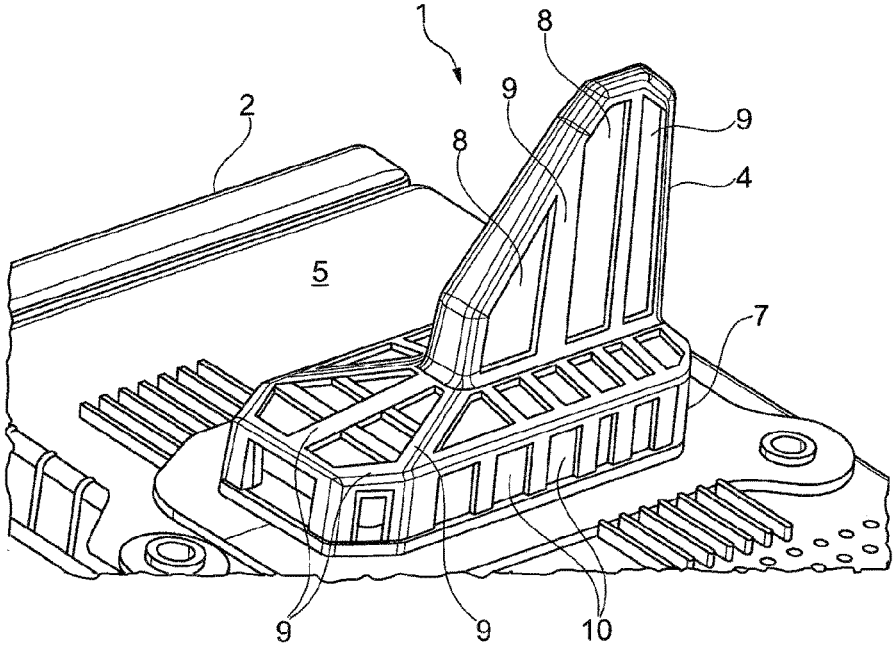
FIG. 3 is a detail perspective view from above of a variant of the invention.

FIG. 3 shows a partial detailed view of the antenna system 1 as in FIGS. 1 and 2. In particular, it can be seen here that an antenna element projects upward past the upper face 5 of the housing 2. Although only one antenna element 8 is shown schematically, several antenna elements of the same type or of different types can also be present.

It can therefore be understood from FIG. 3 that an antenna circuit board that is not shown here is provided with the at least one antenna element 8 inside the outer cover 4. This offers the advantage that the at least one antenna element 8 is protected from external influences. These external influences can be mechanical disturbances during assembly or storage of the antenna system 1. Particularly if no cap 3 is present, the outer cover 4 can also protect the at least one antenna element 8 from external influences such as rain, snow, wind, and the like during operation of the vehicle. In this case, the outer cover 4 is shaped over its entire (external) surface as a aperture (directed downward toward the housing 2) for the insertion of the antenna circuit board with the at least one antenna element 8. In this case, the outer cover 4 forms a cap into which the at least one antenna element 8 or even several antenna elements can be inserted from below and in which the outer cover 4, if it is embodied so as to cover the entire surface, i.e., closed, seals an aperture in a body panel of the vehicle toward the outside when it is passed through the aperture in the body panel.

FIG. 3 shows the alternative, in which the outer cover 4 is formed by struts 9 with interposed recesses 10 and has an aperture for the insertion of the antenna circuit board with the at least one antenna element 8. Such a strut-like outer cover 4 offers mechanical protection for the underlying elements, particularly the at least one antenna element 8 as well as the antenna circuit board. Since such a strut-like outer cover 4 does not protect from water, moisture, snow, dirt particles, and the like, it is necessary for the cap shown in FIG. 3 to also be slipped over the outer cover 4 after installation of the antenna system 1 has been completed. It is conceivable here to attach both the outer cover 4 and the cap 3 to the housing 2, thereby installing the entire antenna system as a module. It is also conceivable, however, for the outer cover 4 to be fixed to the housing 5 and for this module to be installed, in which case the cap 3 is subsequently installed in order to provide complete protection for the underlying elements.

The outer cover 4 with the struts 9 can be manufactured as a one-piece component, for example by a plastic injection-molding process. The way in which struts 9 and interposed apertures 10 are shaped depends particularly on the mechanical forces acting on the outer cover 4 from outside.

Figure 4:
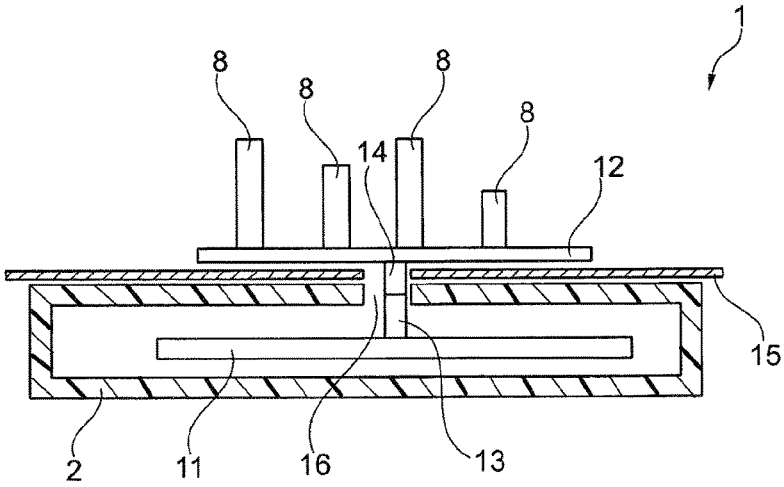
FIG. 4 is a section through another variant of the invention.

Finally, FIG. 4 offers a very good sectional view of the construction of the antenna system 1. Here, the construction and installation of the antenna system 1 is explained using the example of a vehicle that is not shown in further detail. It is also conceivable, however, for the basic construction of the antenna system 1 shown in FIG. 4 to be installed elsewhere, i.e. outside the vehicle. A primary circuit board 11 not carrying a single antenna element is provided in the housing 2. The primary circuit board 8 therefore comprises one or more electronic circuits that process signals that are fed to such a circuit so that they can be emitted at high frequency via one antenna element 8. Alternatively or in addition, high-frequency signals that are received via the at least one antenna element 8 can be fed to an associated electronic circuit, prepared and/or processed there, and fed to electronic devices connected downstream. An antenna circuit board 12 is provided so as to be spaced from the primary circuit board 11 and outside the housing 2, with the at least one antenna element 8, preferably several antenna elements 8 as shown in FIG. 4, being provided on the antenna circuit board 12. What is shown is basically that at least one contact point of an electronic circuit on the primary circuit board 11 is fed to a plug connector 13 and, analogously thereto, a contact point (preferably the base point) of an antenna element 8 is fed to a complementary plug connector 14 of the antenna circuit board 12. The electrical connections between electronic circuit on the primary circuit board 11 and associated antenna element 8 on the antenna circuit board 12 are via the two plug connectors 13, 14. Although not shown, the primary circuit board 11 can also have one or more antenna elements, for example for Wi-Fi, Bluetooth, or the like.

For a case in which the antenna system 1 is mounted on a vehicle, it is shown that this is done on a body panel 15. For example, the body panel 15 of the vehicle can be a roof, trunk lid, or the like. In order to enable the means for connecting the primary circuit board 11 (more precisely, the electronic circuits thereof) to the antenna circuit board 12 (more precisely, the antenna elements 8 thereof) to be passed through the body panel 15, it is necessary for at least this body panel 15 to have an aperture 16. In addition, the housing 2 also has an aperture, so that the two complementary plug connectors 13, 14 can be passed through the aperture of the body panel 15 and the aperture in the housing 2 in order to be plugged together. It is also conceivable for the plug connector 14 to be provided on the antenna circuit board 12 and for a cable to be fed out of the housing 2 on whose end the plug connector 13 is provided. This increases the flexibility of the installation of the housing 2 beneath the body panel 15. It can also be considered to have the plug connector 13 project out of the housing 2 and for the plug connector 14 to be provided at the end of a cable whose other end is connected to the antenna circuit board 12. It is likewise conceivable for a cable to extend both from the primary circuit board 11 and from the antenna circuit board 12, in which case the plug connectors 13, 14 are each provided at the end of a respective cable. The variants with the cable are advantageous particularly if the housing 2 is not, as shown in FIG. 4, provided in the direct vicinity of the antenna circuit board 12, but rather at a distance therefrom. The embodiment shown in FIG. 4 with the two plug connectors 13, 14 plugged directly together and provided on the primary circuit board 11 and on the antenna circuit board 12 is especially preferred due to the short signal paths associated therewith.

While not shown, the antenna circuit board 12 is provided and fastened by connectors to the primary circuit board 11 and/or to the housing 2 and/or to the body panel 15. Such connectors such as screws, snap-fit connections, or the like are required in order to make the entire antenna system 1 a one-piece system in its completed state, thus simplifying installation of such a one-piece antenna system 1. For installation, the entire unit (the antenna module) is installed from the inside (the vehicle) to the outside (outside the vehicle), with prelocking being provided by clips.

For the sake of simplicity, the outer cover 4 is not shown in FIG. 4, but it is present in principle. If the outer cover 4 is embodied so as to cover the entire surface and to have an aperture for insertion of the antenna circuit board 12 with the at least one antenna element 8, an additional outer cover 3 can be omitted. Nonetheless, it can be present in the case of an outer cover 4 that covers the entire surface. In particular, the outer cover 3 is present if the outer cover 4 is formed with struts 9 with interposed recesses 10 as shown in FIG. 3. In these cases, the aperture 16 in the body panel can then be selected so as to be larger and correspond at least to the outer contour 7 of the outer cover 4. This offers the advantage that the outer cover 4 can be passed from below through the aperture 16 in the body panel 5 in order to enable installation of the housing 2 that carries the outer cover 4 underneath the body panel 15. Once this has been done, the cap 3 can be provided and fastened from above on the body panel 15. It is also conceivable for the cap 3 to already be slipped over the outer cover 4 and for the aperture 16 in the body panel 15 to have the outer contour of the cap 3. The antenna system 1 with outer cover 4 and slipped-over cap 3 can then be passed from below through the aperture 16 in the body panel 15 and the housing 2 fastened beneath the body panel 15. Suitable fastening means such as screws, snap-fit connections, adhesive connections, or the like are present for this purpose but not shown in the figures.

The invention claimed is:

1. In combination with a vehicle having a roof panel formed with a throughgoing aperture, an antenna system having a housing on one side of the panel underneath the aperture, a primary circuit board without an antenna element held in the housing, an inner cover separate from the housing and on an opposite other side of the panel above the aperture;

an antenna element inside the inner cover;

an antenna circuit board on the other side of the body panel of the vehicle connected to the antenna element, inside the inner cover, spaced from the primary circuit board, outside the housing, and carrying the antenna element; and a connector extending through the aperture between the primary circuit board and the antenna circuit board.

2. The antenna system defined in claim 1, wherein the connector includes:

a plug connector on the primary circuit board; and another plug connector on the antenna circuit board and fittable with the one plug connector.

3. The antenna system defined in claim 1, further comprising:

an outer cover containing the inner cover holding the antenna circuit board and the antenna element.

4. The antenna system defined in claim 3, wherein the outer cover is formed with a recess for the insertion of the inner cover holding the antenna circuit board and the antenna element.

5. The antenna system defined in claim 4, wherein the outer cover is formed with struts and with recesses between the struts.

* * * * *